US006543358B1

(12) United States Patent
Schneider et al.

(10) Patent No.: US 6,543,358 B1
(45) Date of Patent: Apr. 8, 2003

(54) DEVICE FOR CLAMPING FLEXIBLE PLATES INCLUDING A PIVOTABLE THREE-ARMED PROFILED STRIP

(75) Inventors: Georg Schneider, Würzburg (DE); Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/926,628

(22) PCT Filed: May 25, 2000

(86) PCT No.: PCT/DE00/01700

§ 371 (c)(1),
(2), (4) Date: Nov. 27, 2001

(87) PCT Pub. No.: WO00/73066

PCT Pub. Date: Dec. 7, 2000

(30) Foreign Application Priority Data

May 29, 1999 (DE) ..... 199 24 785

(51) Int. Cl.[7] ..... B41F 27/06; B41F 27/12
(52) U.S. Cl. ..... 101/415.1; 101/378
(58) Field of Search ..... 101/378, 415.1

(56) References Cited

U.S. PATENT DOCUMENTS 2,900,904 A * 8/1959 Hantscho ..... 101/415.1
4,347,788 A * 9/1982 Dufour et al. ..... 101/415.1

FOREIGN PATENT DOCUMENTS

| | | |
|---|---|---|
| DE | 3812137 A1 | 1/1989 |
| DE | 3731039 C2 | 12/1989 |
| DE | 43 35 140 C1 | 2/1995 |
| GB | 2 206 534 A | 5/1988 |

* cited by examiner

*Primary Examiner*—Leslie J. Evanisko
(74) *Attorney, Agent, or Firm*—Jones Tullar & Cooper PC

(57) ABSTRACT

A device for clamping and/or jamming flexible plate beveled suspension legs in a fastening slit of a cylinder of a rotary printing press utilizes a three-armed pivotable profiled strip. This strip is positioned in a cylinder groove and a first arm of the strip can be pivoted by an inflatable air hose. A second arm of the strip can be pressed against a suspension leg in the fastening strip. A third arm of the strip carries a jamming roller that can engage the flexible plate's other suspension leg.

2 Claims, 2 Drawing Sheets

DEVICE FOR CLAMPING FLEXIBLE PLATES INCLUDING A PIVOTABLE THREE-ARMED PROFILED STRIP

FIELD OF THE INVENTION

The present invention is directed to to a device for gripping and/or clamping flexible plates on a cylinder of a rotary printing press. The flexible plate has beveled suspension legs which project into a fastening slit of a cylinder. A groove in the cylinder is in communication with the slit and carries a pivotable profiled strip. The strip uses three strip-shaped arms to clamp the plate end.

DESCRIPTION OF THE PRIOR ART

A device for fixing a flexible printing plate on the forme cylinder of a rotary printing press having at least one cylinder groove extending in the axial direction is known from DE 43 35 140 C1.

In this prior art device, a first, or leading suspension leg, which is beveled at an acute angle, is suspended at an edge of the first groove wall of the cylinder groove of the forme cylinder. A second, or trailing, suspension leg can be placed against the second groove wall, extending approximately in the radial direction of the forme cylinder, of the cylinder groove. The cylinder groove contains a spindle which is pivotable around its axis. Two leaf springs, each of which is distributed over the width of the printing plate, are fastened on the spindle and can be brought into, or out of contact with the suspension legs in the course of pivoting of the spindle.

SUMMARY OF THE INVENTION

The object of the present invention is directed to creating a device for gripping and/or clamping a flexible plate provided with bevel suspension legs on a cylinder having slit fastenings of a rotary printing press.

In accordance with the invention, this object is attained by providing a pivotable profiled strip in the cylinder groove of the cylinder to which the plate is to be attached. This strip is comprised of three profile strip shaped arms. A first one of these arms can be moved against a spring force by an air hose. A second arm can be pressed against one of the plate's suspension legs. The third arm uses a gripping roller to press against the other one of the plate's suspension legs.

The advantages which can be obtained by the present invention consist, in particular, in that a rugged, simply constructed device, which can be produced costeffectively, is created. The device in accordance with the present invention can be displaced, without the turning of a spindle, in only two positions. A further advantage of the present invention lies in that in its axial extension it can consist of several short base bodies. It is possible, because of this, to remove the device laterally piece by piece from the cylinder groove, for example for maintenance purposes, without having to dismount the cylinder from the lateral frame. An automatic plate feeding and removal, through the use of known devices, is possible.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
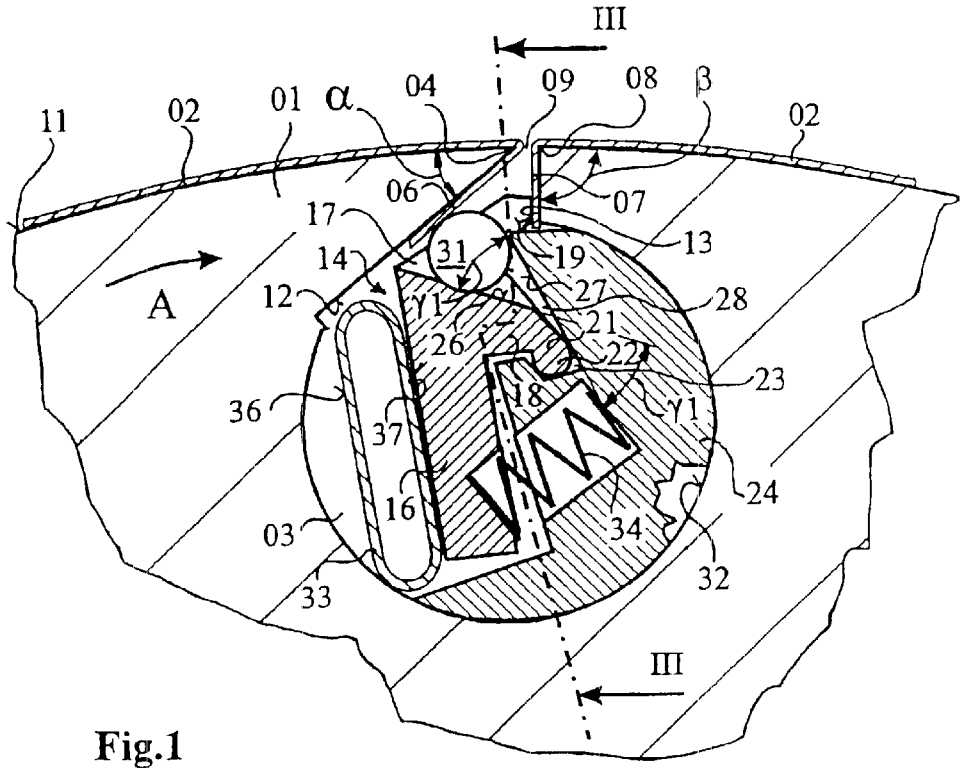
FIG. 1, a device in accordance with the present invention, in cross section, in the plate holding position or position of rest, FIG. 2, a device in accordance with FIG. 1 in a plate receiving or operating position, FIG. 3, a sectional view taken along line III—III in accordance with FIG. 1 in a partial representation on a reduced scale and as a further embodiment.
Figure 2:
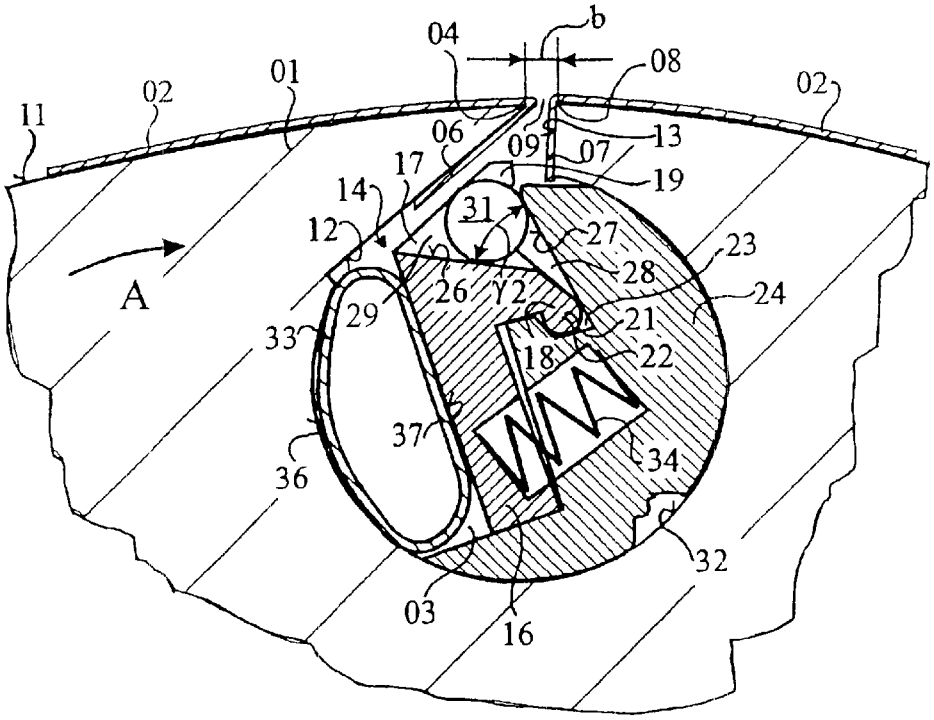

For receiving flexible plates 02, a cylinder 01, for example a plate or rubber blanket cylinder of a rotary printing press, is provided with at least one cylinder groove 03 extending in the axial direction of the cylinder 01, as seen in FIGS. 1 and 2. At a front or leading edge 04, pointing in the production direction A of the cylinder 01, the cylinder groove 03 receives or engages a front, or "leading", suspension leg 06 of the plate 02. The plate 02 also has a rear, or "trailing" suspension leg 07, which is suspended from a second, rear or trailing edge 08 of the same cylinder groove 03.

It is also possible to arrange two plates, which may be, for example, printing plates, on the circumference of the cylinder 01. In this case, two cylinder grooves are required and are spaced apart from each other in the circumferential direction of the cylinder 01.

An acute opening angle a, for example of up to 45°, is formed between the surface 11 of the cylinder 01 and a first cylinder groove wall 12 of the cylinder groove 03. A second cylinder groove wall 13, extending approximately in the radial direction of the cylinder 01, has an obtuse opening angle $\alpha$ of approximately 95° with respect to the surface 11 of cylinder 01. Both edges 04, 08, which are also vertex points of the opening angles $\alpha$, $\beta$, are separated by a fastening slit 09 which they define.

The fastening slit 09 is structured so that its inner width or cylinder surface width b is selected in such a way that at least two suspension legs 06, 07 of flexible plate 02, which project in the direction of the cylinder groove 03, can be placed therein next to each other.

In place of a printing plate or several printing plates placed next to each other, it is possible to also fasten flexible support plates with rubber blankets arranged on them on the surface 11 of cylinder 01.

The cylinder groove 03 can be approximately circular in cross section and is connected with, or accessed from the surface 11 of the cylinder 01 through the fastening slit 09.

A three-armed profiled strip generally at 14, which can be pivoted around its longitudinal axis and whose longitudinal axis extends in the axial direction of the cylinder groove 03, is arranged in the cylinder groove 03. The three arms 16, 17, 18 that comprise the three-armed profiled strip 14 also extend in a strip-like manner in an axis-parallel direction, as seen in FIGS. 1 and 2.

Viewed in cross section, again as shown in FIG. 1, a first, or power arm 16 points approximately in the radial direction of cylinder 01, facing away from the plate 02. A second, or load arm 17 also points approximately in the radial direction, but facing the plate 02. A free end 19 of the second, or load arm 17 is arranged in such a way that it can be pressed against the second suspension leg 07 resting against the second groove wall 13. A third, or seating arm 18, is arranged between the first arm 16 and second arm 17, and its free end 21 is slightly angled off and terminates in a bead 22. This bead 22 is pivotably seated in a channel 23, formed in, and extending in an axis-parallel direction, of a support strip 24 that is fixed in the cylinder groove. The bead 22 and the channel 23 form a bearing.

A wedge-shaped slit 28 is formed between a first, support surface 26, pointing in the direction of the fastening slit 09, of the third, or seating arm 18, and a second support surface 27, fixed on the support strip 24 and arranged at an angle y1 of approximately 30° to 60°, in particular approximately 45°, in respect to the first support surface. The wedge angle y1 can be changed into a wedge angle y2 of approximately 50° by pivoting the three-armed profiled strip 14 as shown in FIGS. 1 and 2.

The first support surface 26 on the third, or seating arm 18 can be constituted, for example, by the second, or load arm 17 having a cutout 29.

The wedge-shaped slit 28, whose wedge angle y can be changed, receives a gripping roller 31. In the plate holding position shown in FIG. 1, the gripping roller 31 rests again the front suspension leg 06 of the flexible plate 02, depending on the size of the wedge angles y1, y2, and pushes the front plate suspension leg 06 leg against the first groove wall 12. This gripping roller moves away from the groove wall 12 in a second, plate receiving position, which second position is shown in FIG. 2.

For generating a required pivot movement of the three-armed profiled strip 14, an actuating element, for example a hose, which can be filled with compressed air, and which is thus called an air hose 33, is arranged between the first, or power arm 16 of the profiled strip 14 and a wall 32 of the cylinder groove 03. On one of its ends, the air hose 33 is provided with a valve, for example, and is charged with compressed air, when needed, via a line, also not represented, to the cylinder journal, and by utilization of a known rotary lead-in.

One or several springs 34, for example compression springs 34, are arranged between the three-armed profiled strip 14 and the support strip 24, whose spring ends are supported, on the one side, on the support strip 24, and on the other side, in blind bores 35 of the side of the first, or power arm 16, remote from the air hose, of the pivotable three-armed profiled strip 14.

If the device for clamping flexible plates in accordance with the present invention is now intended to be brought from the plate holding position or position of rest, shown in FIG. 1, into the plate receiving, or operating position, shown in FIG. 2, the air hose 33 is charged with compressed air. In the course of this, an abutment surface 36 of the air hose 33 now rests against the wall 32 of the cylinder groove 03, and a force-engagement surface 37 of the air hose 33 rests against the first, or power arm 16 of the three-armed profiled strip 14. Because of this, a pivot movement of the profiled strip 14 around the bearing 22, 23 takes place. The free end 19 of the second, or load arm 17 comes out of engagement with the rear suspension leg 07 and the second groove wall 13, as seen in FIG. 2. Moreover, the wedge angle increases from y1 to y2, so that the gripping roller 31 rolls in the direction toward the vertex point of the wedge angle y2 as may be seen in FIG. 2. Because of this, the circumference of the gripping roller 31, which was in contact with the front suspension leg 06 of the flexible plate 02, now comes out of engagement with the front suspension leg 06, which up to now had been pressed against the groove wall 12 by the gripping roller 31. The plate 02 can now be removed, or exchanged. Following the removal of air from the air hose 33, the free end 19 of the second, load arm 17 and the gripping roller 31 again come into operative connection with the suspension legs 06, 07 of the flexible plate 02.

Figure 3:
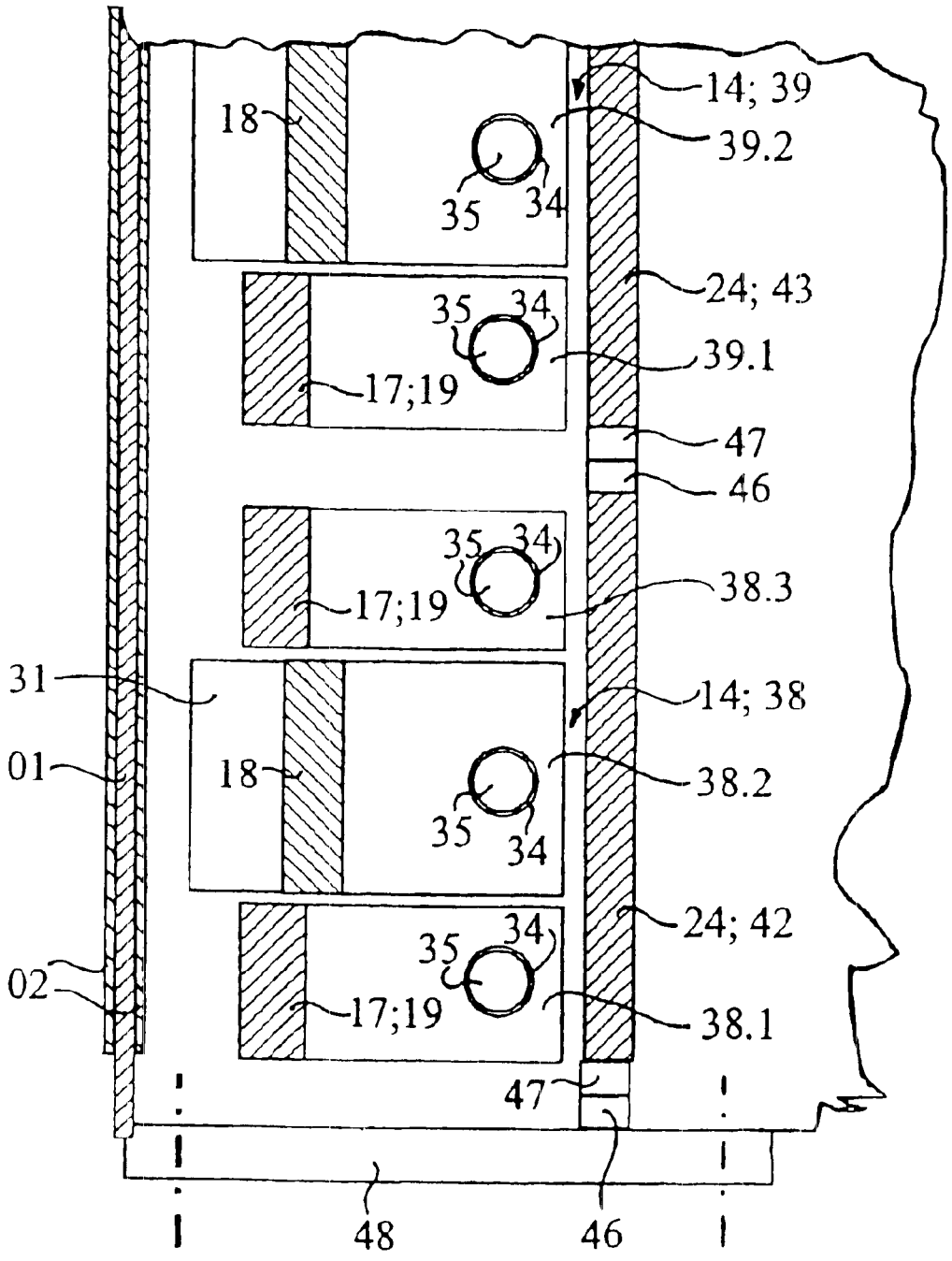

In accordance with an embodiment variation, which is shown in FIG. 3, the three-armed profiled strip 14 may be divided into several short three-armed profiled strips 38.1, 38.2, 38.3; and 39.1, 39.2 which are all extending in an axis-parallel direction. The same applies to the support strip 24, which has also been divided into several short support strips 42, 43. Each of the short support strips 42, 43 or support strip segments is releasably connected with the adjoining short support strip segment, for example by the provision of a coupling. This coupling can act interlockingly, for example, and can be implemented by the provision of teeth 46, 47 on both ends of the short support strips 42, 43. The air hose 33 is always embodied in one piece and passes through the entire cylinder groove 03. A free end of the first and last short support strips 42, 43 located in the cylinder groove 03 is connected, fixed against relative rotation, with an end coupling element 48. The end coupling element 48 is fastened with its portions covering the cylinder groove 03 to the flanks of the cylinder 01, for example screwed to it.

By using several short profiled strips 38.1, 38.2, 38.3; 39.1, 39.2, it is possible to take the device of the present invention out of the cylinder groove 03, for example for maintenance purposes, without it being necessary to dismount the cylinder from the lateral frame.

While preferred embodiments of a device for clamping and/or jamming flexible plates in accordance with the present invention have been set forth fully and completely hereinabove, it will be apparent to one of skill in the art that changes in, for example the specific type of printing press, the drive for the cylinder and the like could be made without departing from the true spirit and scope of the present invention which is accordingly to be limited only by the following claims.

What is claimed is:

1. A device for gripping a flexible plate having beveled suspension legs comprising:

a cylinder of a rotary printing press, said cylinder receiving the flexible plate;

a fastening slit on said cylinder, said fastening slit adapted to receive the beveled suspension legs of the flexible plate;

a cylinder groove in said cylinder, said cylinder groove extending in an axial direction of said cylinder and connected, in a radial direction of said cylinder, with said fastening slit;

a pivotable three-armed profiled strip in said cylinder groove, said three-armed profiled strip including a first, power arm, a second, load arm and a third, seating arm;

an air hose in said cylinder groove, said air hose being in engagement with said first, power arm to shift said first, power arm;

at least one spring in said cylinder groove and positioned to resist said shifting of said first, power arm;

a free end on said second, load arm, said free end of said second, load arm being engageable with a beveled suspension leg of a flexible plate inserted in said fastening slit;

a bearing in said cylinder groove, said third, seating arm being supported in said bearing for pivotal movement of said three-armed pivotable strip in said cylinder groove;

a wedge-shaped slit defined by a surface of said third, seating arm and said cylinder groove, said wedge-shaped slit defining a wedge angle, said wedge angle being changed during said pivotal movement of said three-armed profiled strip; and a roller located in said wedge-shaped slit and engageable with another beveled suspension leg of a flexible plate inserted in said fastening slit.

2. The device of claim 1 wherein said pivotable three-armed profiled strip is comprised of several short profiled strip segments and further wherein said cylinder groove further includes a support strip, said support strip including said bearing, said support strip being comprised of several short support strip segments.

* * * * *